US007528849B2

(12) United States Patent
Borel et al.

(10) Patent No.: US 7,528,849 B2
(45) Date of Patent: May 5, 2009

(54) IMAGE PROCESSING METHOD FOR IMPROVING THE CONTRAST IN A DIGITAL DISPLAY PANEL

(75) Inventors: Thierry Borel, Chantepie (FR); Didier Doyen, La Bouexiere (FR)

(73) Assignee: Thomson Licensing, Boulogne Billancourt (FR)

( * ) Notice: Subject to any disclaimer, the term of this patent is extended or adjusted under 35 U.S.C. 154(b) by 726 days.

(21) Appl. No.: 10/840,184

(22) Filed: May 6, 2004

(65) Prior Publication Data

US 2005/0007391 A1 Jan. 13, 2005

(30) Foreign Application Priority Data

May 7, 2003 (FR) ..... 03 05669

(51) Int. Cl.
*G09G 5/10* (2006.01)

(52) U.S. Cl. ..... 345/690; 345/87; 345/89; 345/102

(58) Field of Classification Search ..... 345/690, 345/87, 89, 102
See application file for complete search history.

(56) References Cited

U.S. PATENT DOCUMENTS 6,795,053 B1 * 9/2004 Funamoto et al. ..... 345/102
2003/0110384 A1 * 6/2003 Carro ..... 713/181

FOREIGN PATENT DOCUMENTS

EP 1111578 A1 6/2001
EP 1014330 A2 6/2002

OTHER PUBLICATIONS

Abstract of Japan Publication 05066501 Publication Date Mar. 19, 1993 App. Date Sep. 9, 1991, App. No. 03227907 Applicant-Toshiba Corp., Inventor-Otaguro Hiroshi Int. Title Projection Type Liquid Crystal Display Device.
Abstract of Japan Publication 09244548 Publication Date Sep. 19, 1997 App. Date Mar. 5, 1996, App. No. 08047698 Applicant-Canon Inc., Inventor—Sakurai Kunio Title Display Device Copyright 1997 JPO.
Article ECMA Standardizing Inf. And Comm. Systems Title 80 mm (1,23 Gbytes per side) and 120 mm (3,95 Gbytes per side) DVD-Recordable Disk (DVD-R) Stand ECMA—279 Dec. 1998—4 pages double-sided.

* cited by examiner

*Primary Examiner*—Richard Hjerpe
*Assistant Examiner*—Leonid Shapiro
(74) *Attorney, Agent, or Firm*—Robert D. Shedd; Harvey D. Fried; James McKenzie

(57) ABSTRACT

The invention relates to a method for processing an image displayed by a display device comprising at least one light source and one light valve. It comprises the following steps:

applying a compression factor C to the grey levels of the image video signal that are higher than a threshold value $NG_1$, the said threshold value being lower than the peak grey level value ($NG_{max}$) of the image video signal, adjusting the luminance of the light produced by the light source to the luminance value corresponding to the peak grey level ($NG'_{max}$) of the image after compression, multiplying the video signal delivered to the light valve by an expansion factor D equal to the ratio of the peak grey level of the image before compression ($NG_{max}$) over the peak grey level of the image after compression ($NG'_{max}$).

10 Claims, 5 Drawing Sheets

IMAGE PROCESSING METHOD FOR IMPROVING THE CONTRAST IN A DIGITAL DISPLAY PANEL

This application claims the benefit, under 35 U.S.C. 119, of French patent application No. 0305669 filed May 7, 2003.

FIELD OF THE INVENTION

The present invention relates to an image processing method for improving the contrast of the video images displayed by a front-projection or a back-projection system. The invention can be applied to video projectors comprising a light valve and a source of illumination for the said valve. The light valve may be of the reflective or transmissive type. The invention is more especially applicable to video projectors comprising a valve of the LCOS, LCD or DLP type.

BACKGROUND OF THE INVENTION

Conventional video projectors comprising a light valve are currently capable of generating images having a contrast of between 500:1 and 1000:1 depending on the valve technology employed. In certain applications, for example digital cinema or top-of-the-range TV sets, this contrast value is not always sufficient. In order to increase this value, a known solution is to modulate the intensity of the light delivered to the valve depending on the contents of the image to be displayed. For example, if the image to be displayed shows a dark scene, the light intensity delivered to the valve is reduced whereas the level of the video signal processed by this same valve is increased in the same proportion. The contrast is now better since the number of bits in the video signal is effectively increased. It is thus possible to achieve a high contrast for the low grey levels which are always critical in TV applications.

One of the known techniques for modulating the light intensity consists in detecting the peak grey level $NG_{max}$ in the image to be displayed and in comparing this with the maximum grey level that can be displayed $NG_{MAX}$ (=255 if the levels use 8-bit encoding):

- if the grey level $NG_{max}$ is below half the grey level $NG_{MAX}$, the intensity of the light delivered to the valve for the image under consideration is divided by 2 and the amplitude of the video signal delivered to the control circuit of the valve is multiplied by 2,
- if the grey level $NG_{max}$ is above half the grey level $NG_{MAX}$, the intensity of the light delivered to the valve remains at its peak value and the level of the video signal delivered to the control circuit of the valve remains unchanged.

This technique is illustrated in FIGS. 1A, 1B and 1C. FIG. 1A shows the video signal as a function of time of two images displayed during frames T and T+1, respectively. This signal is delivered to the control circuit of the valve. The voltage of the level $NG_{max}$ of the first image is lower than the voltage of the level $NG_{MAX}/2$ and that of the level $NG_{max}$ of the second image is higher than the voltage of the level $NG_{MAX}/2$. FIG. 2B shows the light intensity (luminance) delivered to the valve for each of the two images. According to the process previously defined, it is equal to $L_{max}/2$ for the first image and to $L_{max}$ for the second image. The voltage of the video signal of the first image is therefore multiplied by 2 and that of the second image is kept as it is. The rendering of the video levels of dark images is thus enhanced.

This technique presents many drawbacks. The first one of them is that the image contrast is not enhanced whenever an image pixel exceeds $NG_{MAX}/2$. Accordingly, if the image comprises a single luminous point over a dark background, the image contrast is not increased.

In addition, there is a high current demand (during the transition from $L_{max}/2$ to $L_{max}$ or vice versa) within the light source each time there is a transition from an image having a grey level $NG_{max}$ below $NG_{MAX}/2$ to an image having a grey level $NG_{max}$ higher than $NG_{MAX}/2$ or vice versa. Finally, the device responsible for modulating the light delivered to the valve is not able to switch instantaneously from $L_{max}/2$ to $L_{max}$ or vice versa. Consequently, during the transition, the video signal level cannot be correctly adjusted so that areas of blurred image appear during these transition periods.

The invention proposes an image processing method that allows all or part of the above-mentioned drawbacks to be dealt with.

SUMMARY OF THE INVENTION

The present invention relates to a method for processing an image displayed by a display device comprising at least one light source and one light valve for transmitting or reflecting all or part of the light produced by the light source, depending on the video signal of the image to be displayed, characterized in that it comprises the following steps:

- applying a compression factor C to the grey levels of the image video signal that are higher than a first threshold value, the said first threshold value being lower than the peak grey level value of the image video signal,
- adjusting the luminance of the light produced by the light source to the luminance value corresponding to the peak grey level of the image after compression, and
- multiplying the video signal delivered to the light valve by an expansion factor D equal to the ratio of the peak grey level of the image before compression to the peak grey level of the image after compression.

Accordingly, the voltage dynamic range of the grey levels above the said first threshold value is compressed and the dynamic range thus gained is reassigned to the whole image signal.

The invention also relates to a device for displaying an image comprising:

- a light source for producing light,
- a light valve for transmitting or reflecting all or part of the light produced by the light source,
- a circuit for controlling the valve, receiving a video signal of the image to be displayed and delivering a control signal to the said valve that is representative of the image to be displayed, characterized in that the control circuit comprises:

- means for applying a compression factor C to the grey levels of the image video signal that are higher than a first threshold value, the said first threshold value being lower than the peak grey level value of the image video signal,
- means for adjusting the luminance of the light produced by the light source to the luminance value corresponding to the peak grey level of the image after compression,
- means for multiplying the video signal delivered to the light valve by an expansion factor D equal to the ratio of the peak grey level of the image before compression to the peak grey level of the image after compression.

BRIEF DESCRIPTION OF THE DRAWINGS

The invention will be better understood and other features and advantages will become apparent upon reading the description that follows which makes reference to the appended drawings, among which.

DESCRIPTION OF PREFERRED EMBODIMENTS

According to the invention, the grey levels of a restricted number of image pixels (which are the pixels having the highest grey levels in the image) are compressed and the gain in voltage dynamic range is reassigned to the whole image. The compression of the higher grey levels of the image allows the intensity of the light delivered to the light valve to be reduced and the level of the video signal delivered to the valve to then be increased in the same proportion. The contrast of the displayed image can thus be enhanced.

In the remainder of the description, $NG_{max}$ denotes the peak grey level of the pixels of the image to be displayed before compression and $NG'_{max}$ denotes the peak grey level of the pixels of the image to be displayed after compression. In addition, L(NG) denotes the luminance associated with the grey level NG.

According to the invention, the following steps are carried out:

- applying a compression factor C to the grey levels of the image video signal that are higher than a threshold value $NG_1$ with $NG_1<NG_{max}$;
- adjusting the luminance of the light produced by the light source to the luminance value corresponding to the peak grey level of the image $NG'_{max}$ after compression;
- multiplying the voltage level of the video signal delivered to the light valve by an expansion factor D equal to the ratio of the peak grey level $NG_{max}$ of the image before compression to the peak grey level $NG'_{max}$ of the image after compression.

Figure 5:
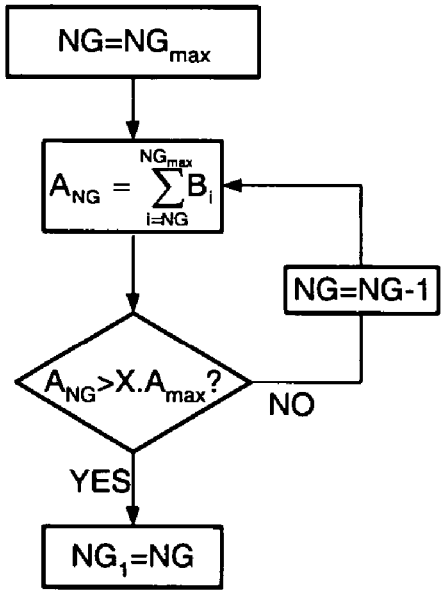
FIG. 5 shows an example of a calculation of the threshold above which the grey levels of the image are compressed.

According to one particular embodiment, the threshold $NG_1$ is, for example, defined as being the value of the lowest grey level of the X brightest pixels of the image, X being a predefined percentage of the number of pixels in the image. For an image comprising 1920×1080 pixels, X is, for example, equal to 10%, or 1920×1080/10 pixels. This threshold varies depending on the image to be displayed. An example of calculation of this threshold will be described below with reference to FIG. 5. In this embodiment, the threshold $NG_1$ is higher or lower depending on whether the image to be displayed is brighter or darker. Preferably, the threshold $NG_1$ is taken as greater than or equal to $$\frac{NG_{MAX}}{2}$$

where $NG_{MAX}$ is the peak grey level that can be displayed by the panel.

Figure 2:
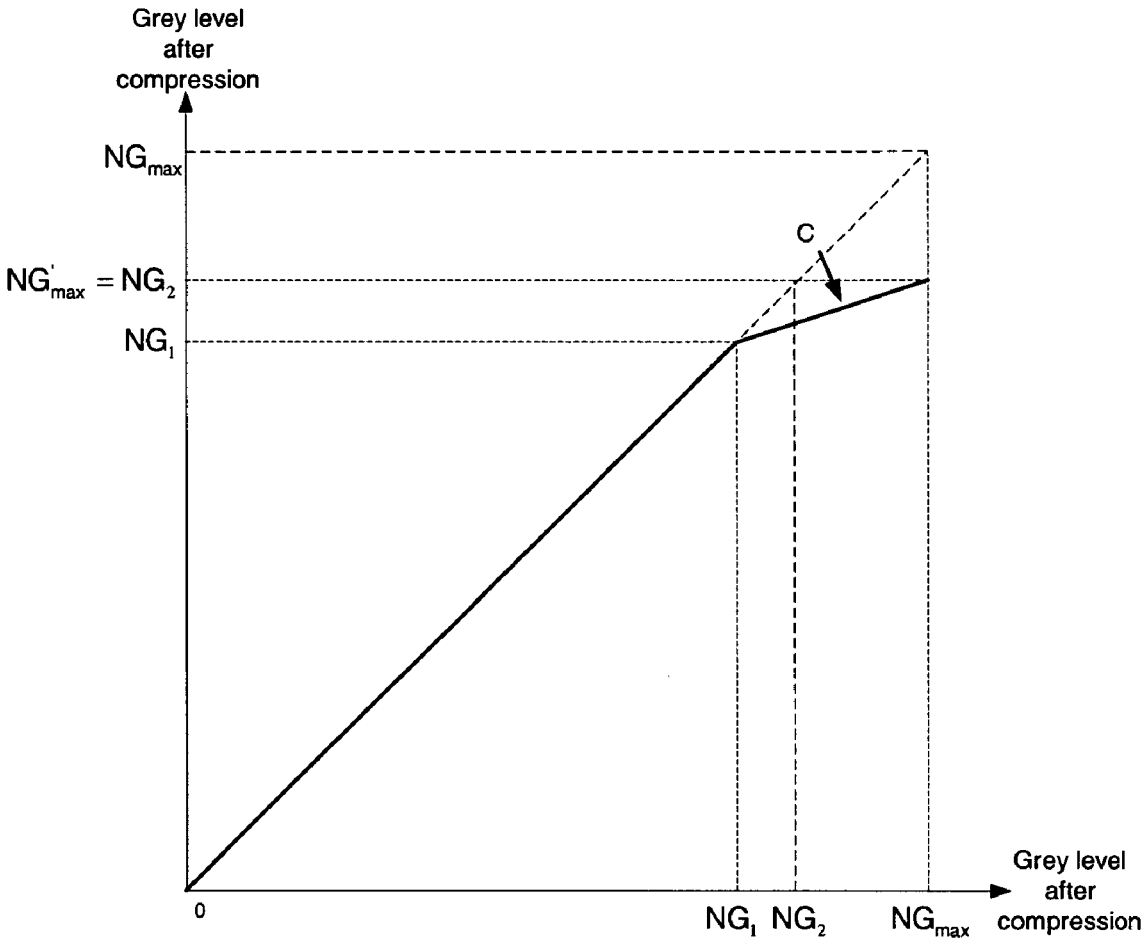
FIG. 2 illustrates the compression of the grey levels above a threshold grey level $NG_1$ according to the invention.

FIG. 2 illustrates the application of a compression factor C to the grey levels of an image situated above the threshold $NG_1$. This figure has an abscissa representing the grey levels of the image before compression and an ordinate representing the grey levels after compression; in this figure $$C = \frac{NG_{max} - NG_1}{NG_2 - NG_1}$$

where $NG_2$ corresponds to the peak grey level after compression $NG'_{max}$.

This compression of the higher grey levels has the effect of reducing the luminance gap between the grey levels above $NG_1$. The luminance of the light required to display the image is therefore brought down to a value $L(NG'_{max})$ corresponding to the luminance value normally associated with the grey level $NG_2$ with $NG_1<NG_2<NG_{max}$.

The closer the grey level $NG_2$ is to $NG_1$, the higher the compression factor is. According to one particular embodiment, the grey level $NG_2$ can be a function of the threshold $NG_1$. For example, $NG_2$ will be taken as equal to the arithmetic mean of $NG_1$ and $NG_{max}$, or:

$$NG_2 = \frac{NG_1 + NG_{max}}{2}$$

In this case, the lower the level $NG_1$ relative to $NG_{max}$ is, the lower will also be the level $NG_2$ and the lower will be the luminance value $L(NG'_{max})=L(NG_2)$.

According to another particular embodiment, the factor C can be kept constant whatever the value of $NG_1$. $NG_2$ will thus increase in the same proportion as $NG_1$.

This reduction in the intensity of light delivered to the light valve ($L(NG_2)$ instead of $L(NG_{MAX})$ where $NG_{MAX}$ is the peak grey level that can be displayed by the screen) allows the multiplication of the amplitude of the video signal after compression by an expansion factor equal to $$\frac{NG_{MAX}}{NG_{max}} = \frac{NG_{MAX}}{NG_2}.$$

Figure 3:
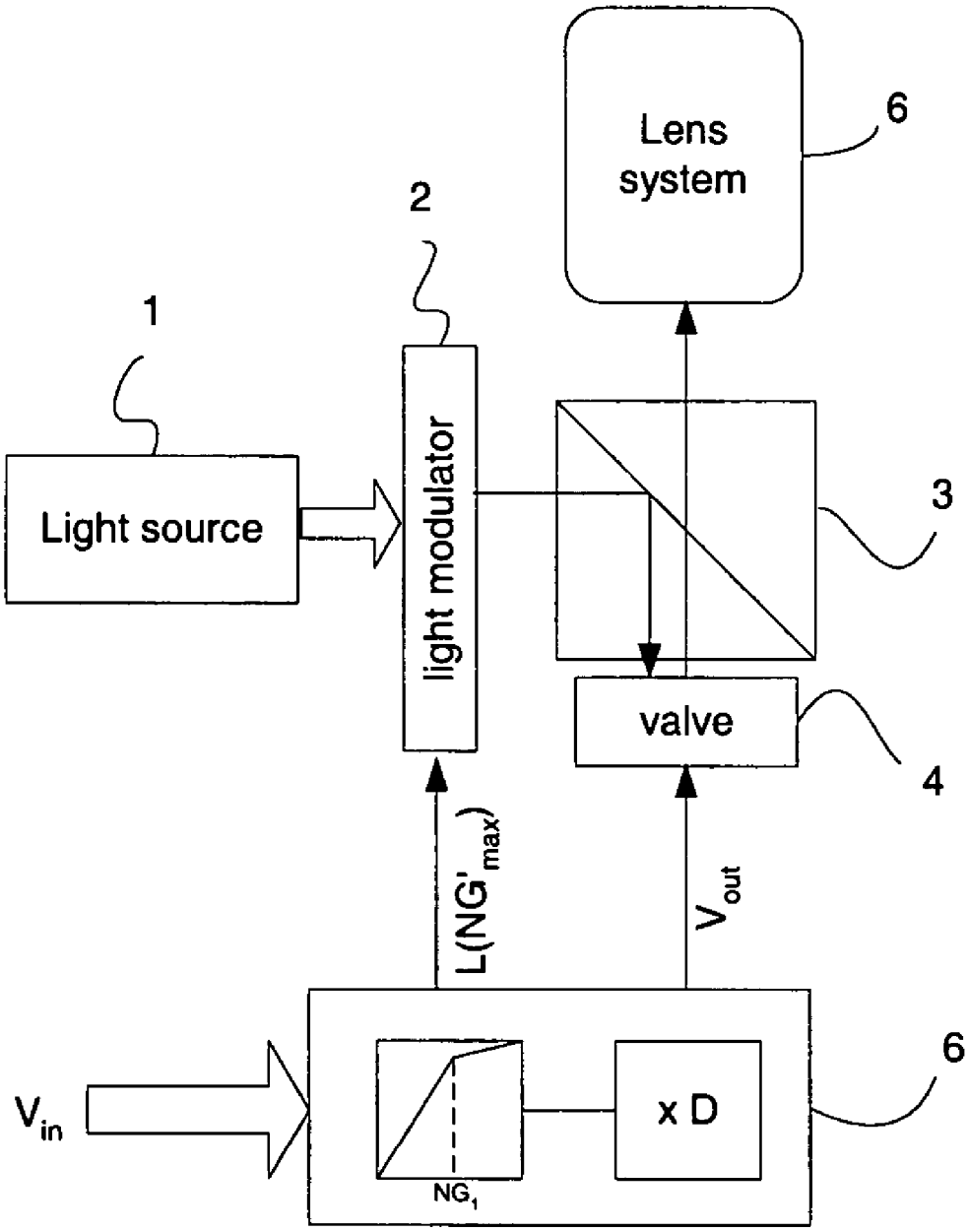
FIG. 3 is a schematic diagram of a video projector in which the method of the invention could be implemented.

A video projector in which the method of the invention is implemented is illustrated in FIG. 3. This projector comprises a light source 1, a light modulator 2 for modulating the intensity of the light produced by the light source 1 as a function of the contents of the image to be displayed, an optical system 3 for sending the light output from the light modulator 2 towards a valve 4 and for sending the image produced by the valve 4 towards a lens system 6. The light modulator 2 and the light valve 4 are controlled by a control circuit 5 which receives the video signal $V_{in}$ of the image to be displayed. It calculates a signal $V_{out}$ to be delivered to the light valve 4 and the luminance value $L(NG'_{max})$ to be delivered to the light modulator 2.

Figure 4:
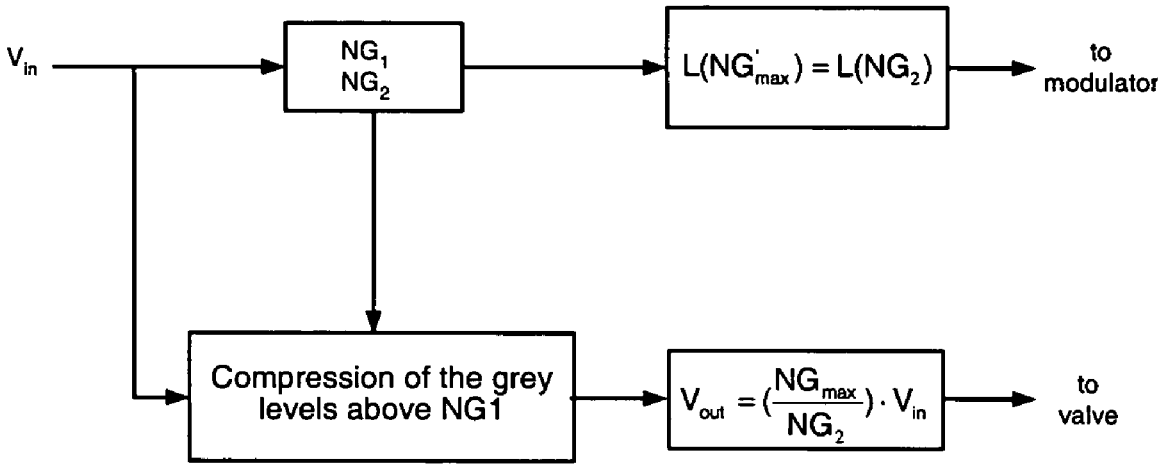
FIG. 4 shows the operations carried out in a control circuit of the video projector in FIG. 3.

A block diagram indicating the steps performed in the control circuit 6 for implementing the method of the invention is shown in FIG. 4.

The control circuit calculates firstly the threshold $NG_1$. An example of calculation of the threshold $NG_1$ is given in FIG. 5. In this figure, NG denotes a grey level index, $B_{NG}$ denotes the number of pixels having a grey level NG in the image under consideration and $A_{NG}$ denotes a number of pixels such that:

$$A_{NG} = \sum_{i=NG}^{NG_{max}} B_i$$

with $$A_{max} = \sum_{i=0}^{NG_{max}} B_i$$

($A_{max}$ is equal to the number of pixels in the image).

In order to define $NG_1$, starting from the grey level $NG=NG_{max}$, NG is decremented until $A_{NG}>X.A_{max}$ where X is a percentage of the total number of pixels in the image. X is, for example, equal to 10%. NG is thus decremented until $A_{NG}>A_{max}/10$. The threshold $NG_1$ is then taken as equal to the value NG obtained.

Again referring to FIG. 4, the control circuit subsequently calculates the value of the grey level $NG_2$. It is, for example, equal to the arithmetic mean value of $NG_1$ and $NG_{max}$ as previously indicated.

The luminance value corresponding to the value normally associated with the value of grey level $NG_2$ is sent to the light modulator 2. The intensity of light delivered to the valve 4 by the modulator 2 is thus fixed at $L(NG'_{max})$ for this image.

The control circuit 5 also transforms the video signal $V_{in}$ by compressing the grey levels above $NG_1$ as shown in FIG. 3. This modified signal is then multiplied by an expansion factor $$D = \frac{NG_{max}}{NG_2}$$

in order to reassign the voltage dynamic range unused by the higher levels to the whole video signal. The resulting signal, denoted $V_{out}$, is delivered to the light valve 4. This transformation of $V_{in}$ to $V_{out}$ thus allows the voltage dynamic range of the grey levels above $NG_1$ to be compressed to the benefit of the grey levels below $NG_1$.

Figure 1A:
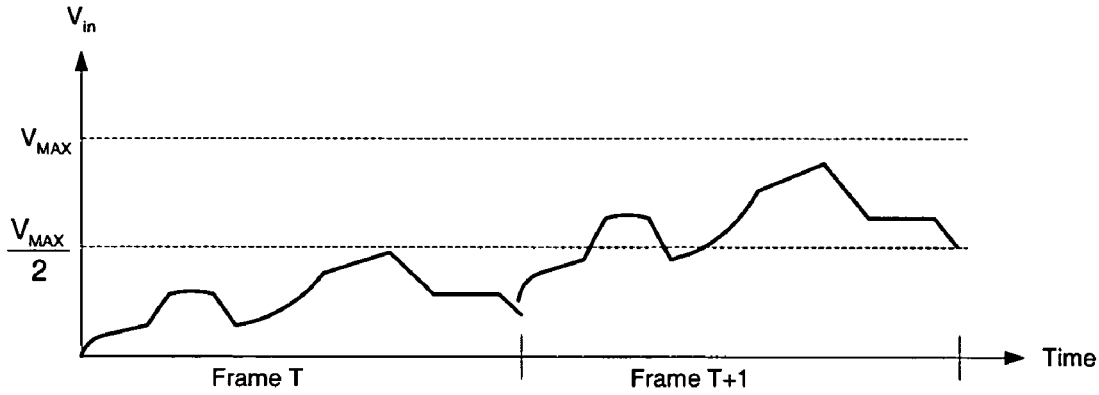
FIGS. 1A to 1C are timing diagrams illustrating the prior art.
Figure 1B:
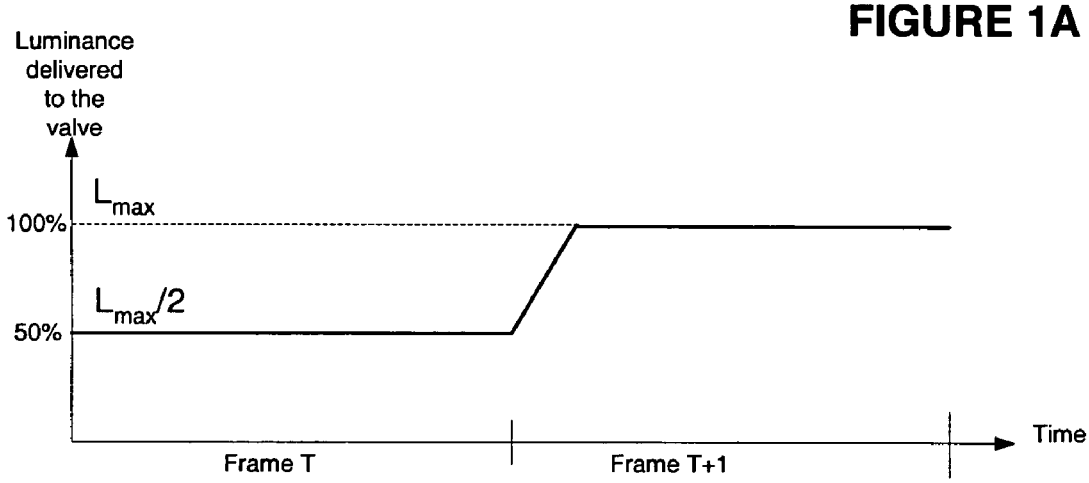
Figure 1C:
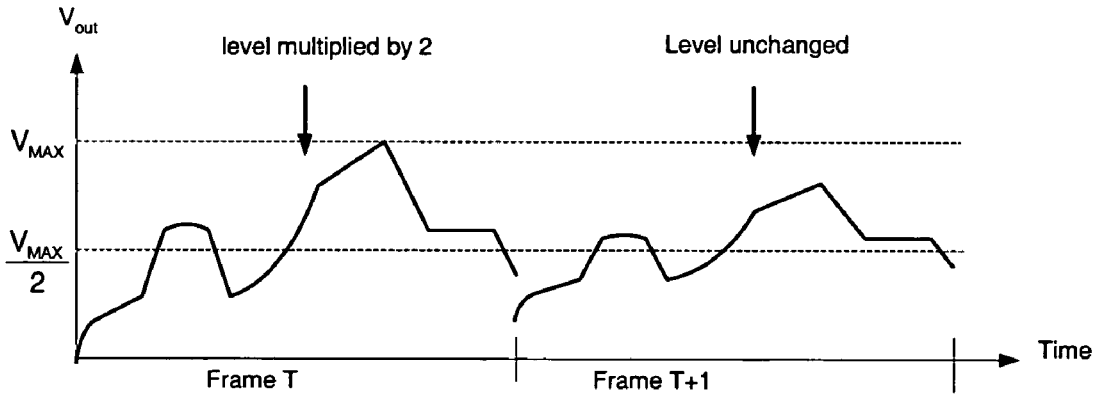
Figure 6A:
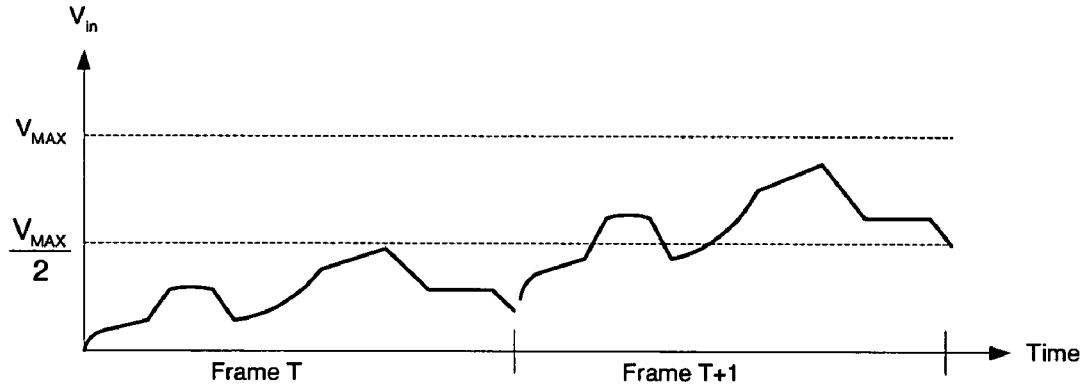
FIGS. 6A to 6C, to be compared with FIGS. 1A to 1C, are timing diagrams illustrating the method of the invention.
Figure 6B:
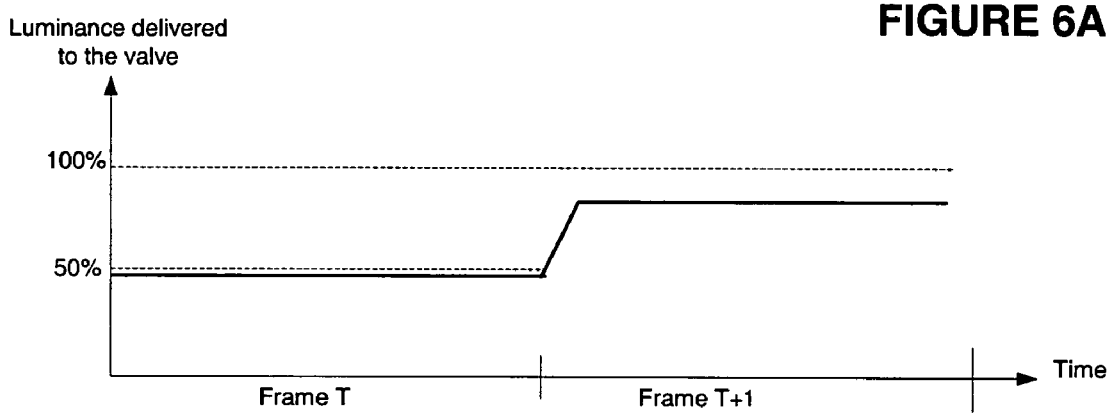
Figure 6C:
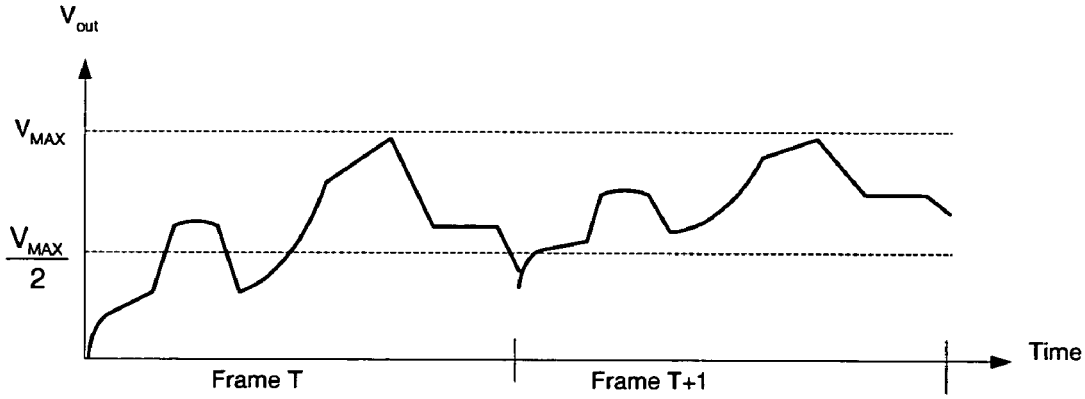

The results of the method of the invention are illustrated by the timing diagrams in FIGS. 6A to 6C which are to be compared with FIGS. 1A to 1C. FIG. 6A is identical to FIG. 1A. FIG. 6B shows the luminance value of the light delivered to the light valve 4. Since the image displayed during the frame T does not comprise any grey level higher than $$\frac{NG_{MAX}}{2}$$

(lower limit of $NG_1$), no grey levels in this image are compressed. The video signal of this image is however multiplied by an expansion factor that is close to 2 in the present case; this is the image of the frame T+1 which does comprise grey levels higher than $$\frac{NG_{MAX}}{2}.$$

The highest grey levels in this image are therefore compressed. The image video signal is multiplied by a smaller expansion factor than that of the T image.

It will be clear to those skilled in the art that other methods of calculating the values $NG_1$ and $NG_2$ than those described herein above could be employed in order to implement the method of the invention.

The invention claimed is:

1. Method for processing an image displayed by a display device comprising at least one light source and one light valve for transmitting or reflecting all or part of the light produced by the light source, depending on the video signal of the image to be displayed, characterized in that it comprises the following steps:

applying a compression factor C to the grey levels of the image video signal that are higher than a first threshold value, the said first threshold value being lower than the peak grey level value of the image video signal, adjusting the luminance of the light produced by the source to the luminance value corresponding to the peak grey level of the image after compression, and multiplying the video signal delivered to the light valve by an expansion factor D equal to the ratio of the peak grey level of the image before compression to the peak grey level of the image after compression.

2. Method according to claim 1, characterized in that the first threshold value is equal to the lowest grey level of the X brightest pixels of the image to be displayed, X being a predefined percentage of the number of pixels in the image.

3. Method according to claim 2, characterized in that the compression factor C is taken equal to the ratio of the difference between the peak grey level value of the image before compression and the said first threshold value to the difference between a second threshold value and the said first threshold value, the second threshold value corresponding to the value of the peak grey level of the image after compression.

4. Method according to claim 3, characterized in that the second threshold value is dependent on the first threshold value.

5. Method according to claim 4, characterized in that the second threshold value is the arithmetic mean value of the first threshold value ($NG_1$) and the peak grey level value that can be displayed by the said display device.

6. Method according to claim 4, characterized in that the compression factor C is constant whatever the said first threshold value, the difference between the said second threshold value and the said first threshold value thus being constant.

7. Method according to claim 1, characterized in that the first threshold value is greater than or equal to half the maximum value of grey level that can be displayed by the said display device.

8. Device for displaying an image comprising:

a light source for producing light, a light valve for transmitting or reflecting all or part of the light produced by the light source, a circuit for controlling the valve, receiving a video signal of the image to be displayed and delivering a control signal to the said valve that is representative of the image to be displayed, characterized in that the control circuit comprises:

means for applying a compression factor C to the grey levels of the image video signal that are higher than a first threshold value, the said first threshold value being lower than the peak grey level value of the image video signal, means for adjusting the luminance of the light produced by the light source to the luminance value corresponding to the peak grey level of the image after compression, and means for multiplying the video signal delivered to the light valve by an expansion factor D equal to the ratio of the peak grey level of the image before compression to the peak grey level of the image after compression.

9. Display device according to claim 8, characterized in that the light valve is a liquid crystal valve.

10. Display device according to claim 8, characterized in that the light valve is a micro-mirror valve.

* * * * *